US006063992A

United States Patent [19]

Schwagerl

[11] Patent Number: 6,063,992

[45] Date of Patent: May 16, 2000

[54] PRACTICE DRUMMING PAD

[76] Inventor: Richard P. Schwagerl, 385 Palos Verdes Dr. West, Palos Verdes Estates, Calif. 90274

[21] Appl. No.: 09/134,232

[22] Filed: Aug. 14, 1998

[51] Int. Cl.[7] ..... G10D 13/02

[52] U.S. Cl. ..... 84/411 P; 84/411 R

[58] Field of Search ..... 84/411 P, 411 R, 84/411 M, 465, 477 R, 738, DIG. 12, 723, 743, 627, 27, 609, 639, 640; 446/418, 408, 397, 175

[56] References Cited

U.S. PATENT DOCUMENTS

| | | | |
|---|---|---|---|
| D. 319,650 | 9/1991 | Hart | D17/22 |
| D. 320,035 | 9/1991 | Magruder | D17/22 |
| D. 386,780 | 11/1997 | Ohno | D17/22 |
| 1,346,588 | 7/1920 | Bower . | |
| 4,179,974 | 12/1979 | Trankle | 84/411 |
| 4,406,207 | 9/1983 | Criscione | 84/411 P |
| 4,469,004 | 9/1984 | Kurosaki | 84/411 |
| 4,581,972 | 4/1986 | Hoshino | 84/411 |
| 4,581,973 | 4/1986 | Hoshino | 84/411 |
| 4,589,323 | 5/1986 | Belli | 84/411 |
| 4,817,489 | 4/1989 | Chabal | 84/411 |
| 5,115,706 | 5/1992 | Aluisi | 84/723 |
| 5,492,047 | 2/1996 | Oliveri | 84/411 |
| 5,520,090 | 5/1996 | Eagle | 84/411 |
| 5,585,583 | 12/1996 | Owen | 84/470 R |
| 5,801,320 | 9/1998 | Segan et al. | 84/738 |

*Primary Examiner*—Robert E. Nappi
*Assistant Examiner*—Kim Lockett
*Attorney, Agent, or Firm*—Cislo & Thomas, LLP

[57] ABSTRACT

A practice drumming provides generally quieter, silent drumming practice for a drummer in combination with a realistic drumkit depiction for better visual cuing and development of muscle memory. The drum pad is constructed of shock absorbing material to dampen the impact of drumsticks and reduce the corresponding noise generated thereby. The drum pad has a non-skid bottom in order to hold it in place on any generally available surface. A realistic depiction of a drumkit or the like is provided on the top of the drum pad. This realistic depiction allows the student to concentrate on playing different drums thereby developing the thought processes necessary for dynamic drumming as well as the muscle memory involved for such dynamic drumming. A pair of drumsticks may accompany the drum pad of the present invention. Additionally, recording media such as an audio CD can provide melodic or rhythmic "grooves" that may be practiced by the student in order to achieve drumming facility. In an alternative embodiment, the drum pad of the present invention may be circular so that it may be placed, with its realistic depiction of a drumkit, upon a single snare drum. This alternative embodiment dampens the impact of drumsticks while allowing the student to practice upon a real drum. In a second alternative embodiment, a snare drum adapter may be used in conjunction with a square or rectangular drum pad to achieve generally the same effect.

18 Claims, 1 Drawing Sheet

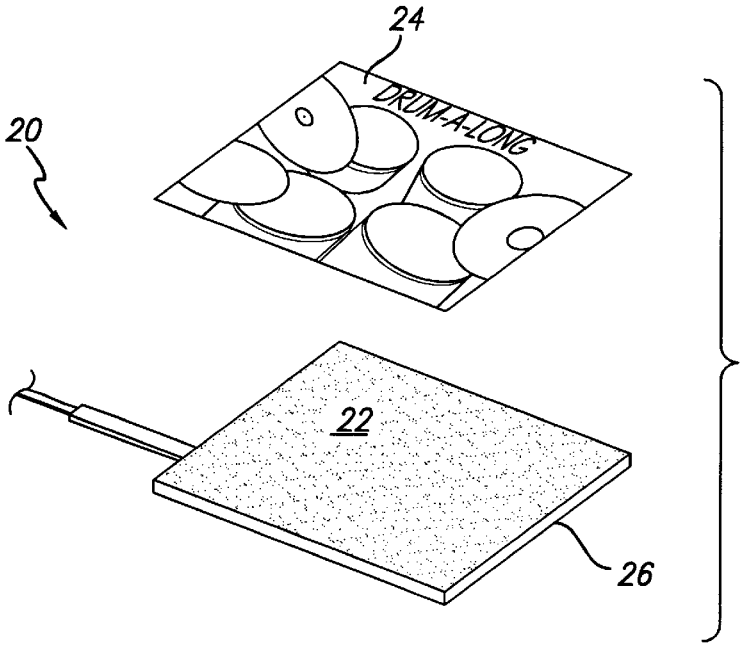
FIG. 1
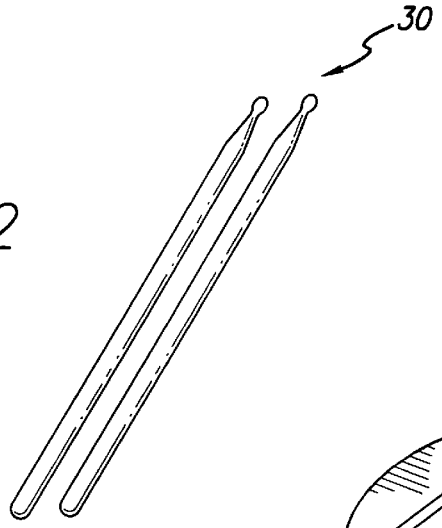
FIG. 2
FIG. 3
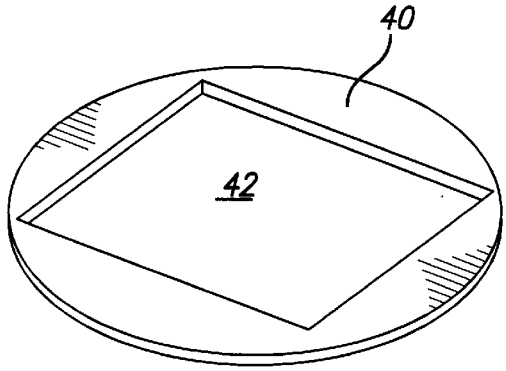
FIG. 4
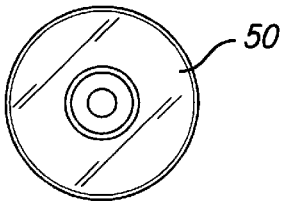

PRACTICE DRUMMING PAD

BACKGROUND OF THE INVENTION

1. Field of the Invention

This invention relates to music practice, and more particularly to a practice drumming pad that allows a drumming student or a drummer to practice drumming in a generally quiet or silent manner with a high degree of realism.

2. Description of the Related Art

Drumming, or rhythm making, is a common element of music making throughout the world. Generally, drumming requires the creation of rhythms on percussion instruments such as drums or the like. Over the past several years, contemporary music has developed more reliance upon rhythms effected by a drummer sitting behind a drumkit. One example of this is the contrast between rock n' roll music and that of the big band era.

One drawback to the practice of drums is that it is often practiced with exuberance by those of a younger age, much to the chagrin of those who are their elders, particularly their parents. Modern drumming is often accompanied by the loud drumming and crashing sounds of the drummer's practice sessions. While such practice enables one to become more proficient in drumming, the din it creates can be aggravating for those in the generally area. While it is possible to provide an acoustically-isolated room for the drummer, such structural retrofitting is often expensive and may only be required temporarily. Alternatively, the purchase or lease of dedicated practice space, such as a studio, may also be expensive.

Consequently, it becomes disadvantageous to promote the practice of drumming as the resulting noise may be quite loud. In the past, alternatives have been realized through previously-known attempts to resolve such difficulties.

In all of such prior attempts to provide drum pads or the like, no instructional facility was conferred to the student in combination with a unique drumming pad overlay that provided the student accurate visual depictions to the drumkit of interest. Consequently, such students were left on their own to flounder and work out for themselves the dynamics of drumming in order to increase proficiency in skill. By not providing a realistic image of the basic or desired drumkit, only limited visual cues were available. These prior attempts in the art have served to advance in some measure the students or professional's drum practice. However, especially for the students just starting out, more advantage would be provided and more drumming skill and pleasure conferred by providing greater instructional and environmental accommodation and cues so that a more realistic drumming practice experience could be delivered.

SUMMARY OF THE INVENTION

The present invention remedies many of the shortcomings of the prior art by providing a practice drum pad that enables the student to use actual drumsticks in a generally silent or quiet manner. The drum pad has a main pad portion used to absorb the shock of the drumsticks' impact. Overlaying the main shock absorbing pad is a realistic depiction of a drumkit or similar percussion setup so that the student or musician may practice, both mentally and physically, the transfer of rhythms between different drums or other percussion instruments as well as beating out rhythms on different percussion instruments at the same time. Additionally, a non-skid bottom surface is provided so that physical stability is delivered to the drum pad as a whole.

Generally, the material used to absorb the shock of the drumsticks pounding has low friction, enabling the pad to slide as practice is made.

Accompanying the drum pad with its realistic depiction of a drumkit, an acoustical sensor may be used to detect and deliver electrical signals to indicate the impact of the drumstick. The acoustical pickup may be electronically connected to headphones or the like so that a more realistic experience is delivered to the practicing drummer while maintaining the generally silent ambient atmosphere around him or her. In order to foster greater ability in playing with other musicians, a sound recording (such as that on an audio CD) may also be included with the present invention in order to provide a more musically complete experience in practice sessions.

By providing a unique combination, the drum pad, the visual overlay, drumsticks and musical media, the student will achieve a better understanding and greater proficiency with drumming. Not only is rhythmic acumen increased, but general muscle memory is improved by directing the student's attention to particular localities present on the life-like depiction of a drum kit used on the graphic overlay.

OBJECTS OF THE INVENTION

It is an object of the present invention to provide a practice drumming pad for a generally quiet or silent drumming practice.

It is another object of the present invention to provide instructional means by which a student may practice drums to increase drumming proficiency.

It is another of the present invention to provide visual cues under realistic circumstances to enhance mental rhythmic dynamics and accompanying muscle memory.

It is another object of the present invention to provide a practice drumming pad that allows a student to learn to play the drums from the ground up.

These and other objects and advantages of the present invention will be apparent from a review of the following specification and accompanying drawings.

BRIEF DESCRIPTION OF THE DRAWINGS

FIG. 1 is an exploded view of the practice drumming pad of the present invention, including the realistic drumkit depiction of the graphical overlay as well as the acoustical pick up in non-skid bottom layer.

FIG. 2 is a pair of drumsticks used in conjunction with the drumming pad FIG. 1 in order to effect drumming practice.

FIG. 3 is a snare drum adapter for use in conjunction with the drumming pad of FIG. 1.

FIG. 4 is an audio CD recording media or the like for recordation of practice "grooves" or the like that when played may be accompanied by these students.

DESCRIPTION OF THE PREFERRED EMBODIMENT(S)

The detailed description set forth below in connection with the appended drawings is intended as a description of a presently preferred embodiment of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequence may be accomplished by different embodiments that are also intended to be encompassed within the spirit and scope of the invention.

The accompanying drawings show that the several components of the present invention are designed to provide a more realistic drumming experience for drummers and drumming students while practicing in a quiet or silent manner upon a drumming pad. In FIG. 1, the drum pad 20 has a shock-absorbing main pad 22 having a graphic overlay 24 realistically depicting a drum set. A non-skid bottom layer 26 serves to prevent the drum pad 20 from sliding on an adjacent surface beneath it. Also shown in FIG. 1 is an acoustical pickup 28 that serves to transmit electrical signals when the drum pad 20 is struck by drumsticks 30.

The main shock absorbing pad absorbs shocks transmitted to it as by drumsticks 30 or the like. In absorbing such shock, the main drum pad 22 dampens the sound that would otherwise be transmitted from the drumsticks' impact.

The shock absorbing main pad 22 may be square, rectangular or circular in shape according to the preferences, desires, and convenience of the student or other practitioner. In a rectangular embodiment (including square shapes), a main drum pad 22 is conveniently portable and easily carried from place to place. Along with drumsticks 30, the rectangular drum pad 20 can be easily carried in a backpack, satchel, or the like. In a circular embodiment, the main drum pad 22 may serve as an enhancement to an actual drum, such as a snare drum, by fitting over the top skin of the drum and dampening impacts from drumsticks 30 or the like. In so acting as a snare drum enhancer/dampener, the student or musician may obtain enhanced practice experience as an actual drums being used for practice purposes. However, with the circular enhancer/dampener, the main drum pad 22 serves to reduce the noise transmitted or created by the associated drum. Alternatively, the circular drum pad (like the rectangular drum pad) can be used on any firm flat surface for drum practicing purposes. The snare drum enhancer may be approximately 13" in diameter.

In an alternative embodiment, a snare drum adapter 40 can be used in conjunction with a rectangular drum pad 20 much in the same way as a completely circular drum pad. The aperture 42 accommodates a rectangular drum pad 20 in a generally snug fit with the entire snare drum adapter 40 and drum pad 20 configuration fitting onto the top skin of a drum, such as a snare drum. As the drum pad 20 has a non-skid bottom layer 26 and as the rectangular drum pad 20 fits within the snare drum adapter aperture 42, a snare drum enhancer/dampener is achieved much in the same way as the circular embodiment of the drum pad 20.

The main drum pad 22 may be constructed of closed- or open-cell NEOPRENE®. Such celled NEOPRENE® serves to absorb shock such as that transmitted by the drumsticks, thereby dampening any acoustic or noise transmission often arising from the beating of the drumsticks upon it. The celled NEOPRENE® serves to distribute and dampen the impact thereby muffling or dampening the noise often accompanying drumstick strikes.

In dimensions, a rectangular embodiment of the main pad 22 may be approximately a quarter to a half inch thick depending upon the acoustic dampening properties of the material. In the rectangular embodiment of the main drum pad 22, the rectangular shape may be achieved by a main drum pad 22 approximately 12" wide and 10" long. In order to accommodate the graphic overlay 24 with its realistic depiction of a drum kit, the rectangular main drum pad 22 may be disposed or situated according to its width. Such width allows a better lateral freedom for the drummer or musician using the drum pad 20.

The skid-resistant bottom layer 26 prevents the drum pad 20 from slipping and/or sliding from surfaces. Materials and/or substances that may be used for the non-skid bottom layer include NEOPRENE® webbing, woven fabric, and/or silkscreen or other graphics material attached to or overlaid upon the bottom of a main pad 22. Such graphics-applying material may also include the results of a sublimation or four-color process.

The graphical overlay 24 has a realistic depiction of one or more percussion instruments including standard rock drum kits, marimbas, steel drums, and the like. Other configurations of drums, cymbals, chimes, gongs, high hats, etc. may also be set forth according to the preference or commercial convenience of the manufacturer or consumer.

By providing a realistic depiction, and not just some general resemblance, of musical and/or percussion instruments, the student is given a high degree of visual cuing with respect to the actual percussion setup that will ultimately be used to achieve the rhythms and/or music desired by the student. As with all practice, musical practice ultimately is directed to the end results of actually playing the instruments according to the desires of the musician.

Such desires may be dictated by sheet music or the like. However, ultimately it is the musician who is responsible for the music and the responsiveness of the audience thereto.

Such realistic visual depictions as embodied in the graphical overlay 24 also allows greater development of muscle memory and visual acumen in directing the drumsticks to specific areas. Such drumstick control is an important part of percussion practice as it is the control over the drumsticks (mallets, brushes, spoons, and even fingers) that controls the ultimate response of the percussion or musical instruments. Additionally, the student may enhance by imagination or mental process the silent or quiet practice session as the realistic visual depiction will allow the student to better achieve a more realistic quiet/silent practice session.

There is also an enhanced degree of visual appeal in providing a realistic depiction of a drum set, marimba, etc. Additionally, the graphical overlay 24 could also include a wrapping sheet or other sturdy overlay that fits over the main drum pad 22. The graphical overlay 24 may be configurable for the relative spacing of the percussion instruments of interest.

As shown in FIG. 2, drumsticks are used to beat out the rhythms or otherwise strike the drum pad 20. However, as is known in the art, other implements may be used to create percussion sounds, including: brushes, mallets, spoons, and even fingers. By use of the term drumsticks herein, reference is made to all such available implements that may be used to beat out rhythms and/or strike sounds from percussion and related instruments.

An acoustical pickup 28 can be attached or otherwise associated to the drum pad 20 in order to detect drumstick strikes or the like. The acoustical pickup transmits an electrical signal along a wire or cable upon detecting a drumstick strike. The acoustical pickup 28 may include a piezoelectric mechanism to create the electrical signal. A plug or socket can then transmit such a signal to an amplifier or headphones for pick up by the student or recording machine. The acoustical pickup allows for a greater musical or percussion experience by the student as the electronic signals transmitted by the acoustical pickup 28 could be converted into drum sounds by a synthesizer or the like.

A plurality of such acoustical pickups 28 could be used in association with the drum pad 20 of the present invention corresponding to each of the number of instruments present on the graphical overlay 24. By appropriately setting the sensitivity of the acoustical pickups 28 and transmitting the signals to an appropriate synthesizer, a number of sounds related to the depictions on the graphical overly 24 could be achieved and transmitted to the student or other recording device. However, beyond the student's hearing outside his or her headphones, the relative quiet of the dampened drumming sounds would be all that would be heard near the student.

Simplified or accommodating sheet music can also be provided to the student in order to better acquaint the beginner to drumming rhythms as recorded on paper. While an established notation system is currently in use and provides those acquainted with it the necessary rhythm information, a simpler version could provide the rank novice the ability to enjoy drumming and to establish good rhythmic practice.

In the Drum-A-Long™ play by number system, each drum, percussion instrument, or striking area can be assigned a unique number. Rows of rhythm beats are then provided for the right hand, left hand, and, possibly, the right and left feet. In one embodiment, the time signature or beat is used as the bottom row to indicate the coordination of the right and left hands. If a snare drum were designated as instrument 1 and the cymbal as instrument 2, the Drum-A-Long™ play by number system could yield the following result for a quarter note "groove" in a 4/4 time signature:

| Quarter note groove | | | | |
|---|---|---|---|---|
| Right hand: | 1 | 1 | 1 | 1 |
| Left hand: | — | 2 | — | 2 |
| (count): | 1 | 2 | 3 | 4 |

In the example, above, the right hand beats the snare drum every beat while the left hand beats the cymbal every two beats, on beats two and four.

As an additional enhancement and component of the present invention, an audio CD or other recording medium could provide "grooves" or musical tracks providing examples for the student and accompaniment therefore. In one embodiment, the audio CD 50 may provide music in stereo with separate left and right channels. The left channel could be a drumming track providing an example for the student of proper drumming. In synchronization with, and complementary to the drumming track, the right channel could provide a musical track having no percussion instruments. The accompanying music track of the right channel could be based on music played by guitars, or otherwise. The student would then have a choice of listening to one or both channels in order to provide respectively, drumming technique, musical accompaniment, or both.

Other percussion or strike-based instruments could also be accommodated by the audio CD 50 of the present invention. In such cases, the appropriate accommodations could be made such as that for a steel drum. Also, Latin percussion set-ups, steel drums, and marimbas can also be accommodated by the graphical overlay 24 of the present invention.

In an alternative embodiment, a recording medium in the form of a video, videotape, or other audiovisual work may be included with the drum pad 20 of the present invention. By practicing upon the drum pad 20 while situated in front of the playing video, the student could follow the movements of a drum player who recorded his actions while having a video camera strapped to his forehead or otherwise showing his movements. Due to the high fidelity nature of such audiovisual works, a stereo set or other audio reproduction equipment could provide audio accompaniment in the same way as the audio CD 50.

Additional embodiments of the present invention include the use of the drum pad 20 in conjunction with tone drums such that the drum pad 20 is used to fit upon a custom-made tone drum, fitting into the cuts in the wood that would be the same size as the drum pad 20. Each of the tone drum segments would correspond to a different tone and sound thereby providing proper tone drum response. Additionally, another alternative embodiment of the present invention includes the use of a miniature version for use of tapping out rhythms upon a realistic graphical overlay depiction with one's fingers. Such a miniature drum pad 20 could be approximately four inches by three inches.

While the present invention has been described with regards to particular embodiments, it is recognized that additional variations of the present invention may be devised without departing from the inventive concept.

What is claimed is:

1. A practice drum pad kit for practicing drums and other rhythmic instruments in a quiet manner, comprising:

a portable drum pad, said drum pad absorbing shocks and dampening acoustic or sound transmission created by such shocks; and a graphic overlay representing a plurality of different percussion instruments of different shapes and sizes, said graphic overlay accurately depicting the plurality of the different percussion instruments arranged to simulate multiple playing surfaces of a conventional drum set, said graphic overlay attached to and visible from a top of said drum pad; whereby a drummer or drumming student may practice drumming in a quiet manner by beating said drum pad, said drum pad generally absorbing shocks created by such beating, said graphic overlay providing at least visual differentiation and distinction between ones of said percussion instruments so that said drummer or drumming student can practice creating rhythms on said instruments and can practice switching drumming between different ones of said instruments, and may visualize the multiple playing surfaces of the conventional drum set and develop a mental image of the motions used for playing the drum set.

2. The practice drum pad kit of claim 1, wherein said drum pad further comprises:

a shock-absorbing main pad; and a skid-resistant bottom layer; whereby the practice drum pad can rest upon a surface without slipping, said skid-resistant bottom layer holding the practice drum pad in place without slippage.

3. The practice drum pad kit of claim 2, wherein said shock-absorbing main pad is constructed of material selected from the group consisting of open cell neoprene and closed cell neoprene.

4. The practice drum pad kit of claim 2, wherein said skid-resistant bottom layer in selected from the group consisting of:

neoprene webbing, woven fabric, and silk-screen or similar graphics-applying material including sublimation process and four-color process.

5. The practice drum pad kit of claim 1, wherein said graphic overlay depicts actual pieces of a real drumset, said graphic overlay depicting such actual drumset pieces in same or similar relative locations as said actual pieces of said real drumset.

6. The practice drum pad kit of claim 1, further comprising:

a pair of drumsticks, said pair of drumsticks for beating or practicing rhythms upon said drum pad.

7. The practice drum pad kit of claim 1, further comprising:

striking implements for striking said drum pad, said striking implements selected from the group consisting of: brushes, mallets, spoons, and fingers.

8. The practice drum pad kit of claim 1, further comprising:

an acoustical impact sensor, said acoustical impact sensor coupled to said drum pad, said acoustical impact sensor transmitting acoustical signals when said drum pad is subjected to shock.

9. The practice drum pad kit of claim 1, wherein said drum pad further comprises:

a generally rectangular drum pad.

10. The practice drum pad kit of claim 9, further comprising:

a snare drum enhancer or adapter, said snare drum enhancer defining an aperture similar in shape to said generally rectangular drum pad, said snare drum enhancer fitting closely upon a head of a snare drum and holding said generally rectangular drum pad in place upon said snare drum.

11. The practice drum pad kit of claim 10, wherein said snare drum enhancer is constructed of material generally the same as that used to construct said generally rectangular drum pad.

12. The practice drum pad kit of claim 1, further comprising:

a recording medium, said recording medium having a recording of drumming rhythms for practicing upon said drum pad by said drummer or said drumming student.

13. The practice drum pad kit of claim 12, wherein said recording media further comprises:

an audio compact disc (audio CD).

14. The practice drum pad kit of claim 13, wherein said audio CD has first and second audio channels, said first audio channel providing a drum soundtrack and said second audio channel providing a music soundtrack, said drum and music soundtracks complementing one another.

15. The practice drum pad kit of claim 12, wherein said recording medium further comprises:

a video recording with an audio soundtrack, said audio soundtrack having first and second audio channels, said first audio channel providing a drum soundtrack and said second audio channel providing a music soundtrack, said drum and music soundtracks complementing one another.

16. A practice drum kit for practicing drums and other rhythmic instruments in a quiet manner, comprising:

a portable drum pad, said drum pad absorbing shocks and dampening acoustic or sound transmission created by such shocks, said drum pad having a shock-absorbing main pad and a skid-resistant bottom layer so that the practice drum pad can rest upon a surface without slipping, said skid-resistant bottom layer holding the practice drum pad without slippage; and a graphic overlay representing two or more different percussion instruments arranged to simulate multiple playing surfaces of a conventional drum set, said graphic overlay attached to and visible from a top of said drum pad, said graphic overlay depicting actual pieces of a real drumset, said graphic overlay depicting such actual drumset pieces in same or similar relative locations as said actual pieces of said real drumset;

a pair of drumsticks, said pair of drumsticks for beating or practicing rhythms upon said drum pad;

an acoustical impact sensor, said acoustical impact sensor coupled to said drum pad, said acoustical impact sensor transmitting acoustical signals when said drum pad is subjected to shock; and an audio recording medium, said audio recording medium having a recording of drumming rhythms for practicing upon said drum pad by a drummer or a drumming student; whereby said drummer or said drumming student may practice drumming in a quiet manner by beating said drum pad, said drum pad generally absorbing shocks created by such beating, said graphic overlay providing visual differentiation and distinction between different ones of said percussion instruments so that said drummer or drumming student can practice creating rhythms on different instruments and can practice switching drumming between different instruments, and may visualize the multiple playing surfaces of the conventional drum set and develop a mental image of the motions used for playing the drum set.

17. The practice drum pad kit of claim 16, further comprising:

a snare drum enhancer or adapter, said snare drum enhancer defining an aperture similar in shape to said generally rectangular drum pad, said snare drum enhancer fitting closely upon a head of a snare drum and holding said generally rectangular drum pad in place upon said snare drum.

18. The practice drum pad kit of claim 17, wherein said snare drum enhancer is constructed of material generally the same as that used to construct said generally rectangular drum pad.

* * * * *